US006183924B1

(12) United States Patent
Nomura et al.

(10) Patent No.: US 6,183,924 B1
(45) Date of Patent: Feb. 6, 2001

(54) ELECTROSTATIC IMAGE DEVELOPER

(75) Inventors: Minoru Nomura, Saitama; Takashi Ito, Tokyo; Hitoshi Takayanagi; Kazuo Itoya, both of Saitama, all of (JP)

(73) Assignee: Daimippon Ink and Chemicals, Inc., Tokyo (JP)

( * ) Notice: Under 35 U.S.C. 154(b), the term of this patent shall be extended for 0 days.

(21) Appl. No.: 09/256,311

(22) Filed: Feb. 24, 1999

(30) Foreign Application Priority Data

| | | |
|---|---|---|
| Aug. 29, 1997 | (JP) | 9-234898 |
| Mar. 31, 1998 | (JP) | 10-086013 |
| Mar. 31, 1998 | (JP) | 9-234897 |

(51) Int. Cl.[7] ..... G03G 9/09
(52) U.S. Cl. ..... 430/106; 430/111
(58) Field of Search ..... 430/106, 111

(56) References Cited

U.S. PATENT DOCUMENTS

| | | | | |
|---|---|---|---|---|
| 4,987,454 | | 1/1991 | Natsuhara et al. | 430/111 |
| 4,996,126 | | 2/1991 | Anno et al. | 430/106.6 |
| 5,164,774 | | 11/1992 | Tomita et al. | 430/109 |
| 5,283,153 | * | 2/1994 | Sacripante et al. | 430/138 |
| 5,348,832 | * | 9/1994 | Sacripante et al. | 430/109 |
| 5,358,811 | * | 10/1994 | Yamazaki et al. | 430/111 |
| 5,637,427 | * | 6/1997 | Yamamoto et al. | 430/109 |
| 5,691,095 | | 11/1997 | Shinzo et al. | 430/106 |
| 5,800,957 | * | 9/1998 | Agata et al. | 430/106 |

FOREIGN PATENT DOCUMENTS

| | | |
|---|---|---|
| 445 986 | 11/1991 | (EP) . |
| 1-158459 | 6/1989 | (JP) . |
| 1-185653 | 7/1989 | (JP) . |
| 2-3074 | 1/1990 | (JP) . |
| 3-100660 | 4/1991 | (JP) . |
| 3-100661 | 4/1991 | (JP) . |
| 3-259161 | 11/1991 | (JP) . |
| 4-276762 | 10/1992 | (JP) . |
| 8-211655 | 8/1996 | (JP) . |
| 8-234493 | 9/1996 | (JP) . |
| 9-15902 | 1/1997 | (JP) . |
| 9-15903 | 1/1997 | (JP) . |
| 9-90671 | 4/1997 | (JP) . |
| 9-179339 | 7/1997 | (JP) . |
| 10-20539 | 1/1998 | (JP) . |
| 10-133453 | 5/1998 | (JP) . |

* cited by examiner

*Primary Examiner*—Roland Martin
(74) *Attorney, Agent, or Firm*—Armstrong, Westerman, Hattori, McLeland & Naughton

(57) ABSTRACT

The present invention provides a novel developer comprising a spherically particulate toner having a volume-average particle diameter of from about 1 to 6 $\mu$m for use in the development of electrostatic image in electrophotographic copying machines or printers having a colorant content of from 8 to 20% by weight, if the colorant is carbon black, or from 3 to 20% by weight, if the colorant is an organic pigment, based on the sum of the weight of binder resin and colorant and a resin-coated carrier having a volume-average particle diameter of from 20 to 150 $\mu$m. The present invention also provides a suitable polymerization or emulsification process for the preparation of a particulate toner to be incorporated in the developer. The use of the electrostatic image developer makes it possible to not only improve the quality of images provided by copying machines or printers but also realize drastic reduction of the amount of toner to be consumed per sheet of printing paper.

38 Claims, No Drawings

ELECTROSTATIC IMAGE DEVELOPER

FIELD OF THE INVENTION

The present invention relates to a novel two-component developer suitable for use in the development of electrostatic image in electrophotographic process copying machines or printers.

BACKGROUND OF THE INVENTION

The state-of-the-art electrophotographic process copying machines or printers are far inferior to lithography or silver salt system photography in image quality. In an attempt to improve the image quality of electrophotographic process copying machines or printers, various efforts have been made to improve toners and carriers constituting the developer, image-forming apparatus, etc.

For the part of toner, it has recently been necessary more and more to reduce the particle diameter of particulate toner in order to improve image quality such as resolution.

Various technical developments have been made. However, most of powder toners for development of electrostatic image commercially available at present have a volume-average particle diameter of from about 8 to 13 μm. Powder toners having the smallest particle diameter have a volume-average particle diameter of about 7 μm (as measured by Coulter Multisizer). Thus, the smallest allowable volume-average particle diameter of particulate toners extremely useful for the enhancement of image resolution is about 7 μm at present. No particulate toners having far smaller particle diameters are commercially produced. Little or no developing machines using such a small particle size toner have been developed.

A powder toner is prepared by a dry process such as pulverization process or a wet process such as polymerization process and so-called phase inversion emulsification method as described in JP-A-5-66600 (The term "JP-A" as used herein means an "unexamined published Japanese patent application") and JP-A-09-311502. It is said that the smallest allowable particle diameter of toners produced by a pulverization process using the present crushing machine on an industrial basis is about 6 to 7 μm. Of course, small particle diameter toners having a particle diameter of about 5 μm can be produced. However, these toners cannot hardly be considered practical because they add to cost and exhibit deteriorated triboelectricity or powder fluidity caused by the reduction of the particle diameter thereof.

The wet process such as polymerization process and emulsification process is said to be essentially free from difficulty for the reduction of the particle diameter of powder toners. However, the prior art wet process toner is mainly intended in the stage of development or production to replace the foregoing pulverization process toner having an ordinary volume-average particle diameter range (about 7 to 13 μm). Electrostatic image developers comprising small particle diameter toners having a volume-average particle diameter of about 6 μm or less have been so far little studied. No practical formulations have been known.

SUMMARY OF THE INVENTION

The inventors made extensive studies of two-component developer for use in the development of electrostatic image which can provide an printed image excellent in density, resolution, tone reproduction, etc. As a result, it was found that the use of a spherically particulate toner having a small particle diameter and a high pigment concentration as a two-component developer in combination with a carrier having a predetermined range of particle diameter makes it possible to provide an excellent image quality and drastically reduce the amount of toner to be consumed per sheet of printing paper. The inventors further found a specific emulsion or polymerization process suitable for use in the preparation of a particulate toner to be used as such a two-component developer.

The present invention provides the following inventions:

1. An electrostatic image developer comprising a spherically particulate black toner containing a binder resin and a colorant and a resin-coated carrier, characterized in that said spherically particulate toner has a volume-average particle diameter of from 1 to 6 μm, said colorant is carbon black, the content of which is from 8 to 20% by weight based on the sum of the weight of said binder resin and said colorant and said carrier has a volume-average particle diameter of from 20 to 150 μm.
2. The electrostatic image developer according to Clause 1, wherein said colorant is encapsulated in said binder resin and said spherically particulate toner has an average circularity of not less than 0.97.
3. The electrostatic image developer according to Clause 1 or 2, wherein said spherically particulate toner has a particle size distribution such that the ratio of 50%-volume particle diameter/50%-number particle diameter is not more than 1.25 and the square root of the ratio of 84%-volume particle diameter/16%-volume particle diameter is not more than 1.25.
4. The electrostatic image developer according to Clause 1 or 2, wherein said binder resin for said spherically particulate toner is a polyester resin.
5. The electrostatic image developer according to Clause 1 or 2, wherein said spherically particulate toner is a negatively polar toner comprising a hydrophobic silica and a hydrophobic titanium oxide externally added thereto.
6. The electrostatic image developer according to Clause 1 or 2, wherein said spherically particulate toner is a particulate toner obtained by a process which comprises mixing a mixture comprising a colorant and a water-insoluble binder resin as essential components and an aqueous medium, emulsifying the mixture to form spherical colored particles, and then withdrawing the said particles dispersed in the liquid medium in the form of dried powder.
7. The electrostatic image developer according to Clause 1 or 2, wherein said spherically particulate is a particulate toner obtained by a process which comprises allowing a polymerizable monomer having a colorant dispersed therein to undergo polymerization in a liquid medium to form spherical colored particles, and then withdrawing the said particles dispersed in the liquid medium in the form of dried powder.
8. An electrostatic image developer comprising a spherically particulate color toner containing a binder resin and a colorant and a resin-coated carrier, characterized in that said spherically particulate toner has a volume-average particle diameter of from 1 to 6 μm, said colorant is an organic pigment, the content of which is from 3 to 20% by weight based on the sum of the weight of said binder resin and said colorant and said carrier has a volume-average particle diameter of from 20 to 150 μm.
9. The electrostatic image developer according to Clause 8, wherein said colorant is encapsulated in said binder resin and said spherically particulate toner has an average circularity of not less than 0.97.

10. The electrostatic image developer according to Clause 8 or 9, wherein said spherically particulate toner has a particle size distribution such that the ratio of 50%-volume particle diameter/50%-number particle diameter is not more than 1.25 and the square root of the ratio of 84%-volume particle diameter/16%-volume particle diameter is not more than 1.25.

11. The electrostatic image developer according to Clause 8 or 9, wherein said binder resin for said spherically particulate toner is a polyester resin.

12. The electrostatic image developer according to Clause 8 or 9, wherein said spherically particulate toner is a negatively polar toner comprising a hydrophobic silica and a hydrophobic titanium oxide externally added thereto.

13. The electrostatic image developer according to Clause 8 or 9, wherein said spherically particulate toner is a particulate toner obtained by a process which comprises mixing a mixture comprising a colorant and a water-insoluble binder resin as essential components and an aqueous medium, emulsifying the mixture to form spherical colored particles, and then withdrawing the said particles dispersed in the liquid medium in the form of dried-powder.

14. The electrostatic image developer according to Clause 8 or 9, wherein said spherically particulate is a particulate toner obtained by a process which comprises allowing a polymerizable monomer having a colorant dispersed therein to undergo polymerization in a liquid medium to form spherical colored particles, and then withdrawing the said particles dispersed in the liquid medium in the form of dried powder.

15. The electrostatic image developer according to Clause 1 or 8, wherein said resin-coated carrier is an almost spherically resin-coated carrier coated with a silicon resin.

DETAILED DESCRIPTION OF THE INVENTION

The inventors made extensive studies of improvement of image quality in two-component development. As a result, it was found that the use of a developer comprising a spherically particulate toner containing a predetermined amount of a colorant and having a volume-average particle diameter of from 1 to 6 μm, more preferably from 2 to 6 μm, even more preferably from 3 to 6 μm and a resin-coated carrier having a volume-average particle diameter of from 20 to 150 μm, preferably from 20 to 120 μm, more preferably from 20 to 80 μm makes it possible to drastically reduce the amount of toner to be consumed per sheet of printing paper in addition to remarkable improvement of image quality.

It was found that the use of a spherically particulate toner containing as a colorant carbon black in a content of from 8 to 20% by weight makes it possible to realize image density at a high standard in addition to image resolution or tone reproduction. It was further found that as a binder resin there may be preferably used a styrene (meth)acrylate resin or polyester resin and the use of a styrene (meth)acrylate resin in particular makes it possible to provide the toner with an excellent fixability.

It was also found that the use of, as a cyan, magenta or yellow color developer, a spherically particulate toner containing as a colorant an organic pigment in a content of from 3 to 20% by weight makes it possible to realize an excellent image quality. It was further found that as a binder resin there may be preferably used a styrene (meth)acrylate resin or polyester resin and the use of a polyester resin in particular makes it possible to exert a remarkable effect of improving hue and gloss.

The inventors further found that the use of a powder toner having an average circularity (average of circularity defined by (perimeter of circle having the same area as the projected area of particle)/(perimeter of the projected image of particle)) of not less than 0.97 comprising a colorant encapsulated in a binder resin makes it possible to satisfy more easily the foregoing requirements for developer and improve image quality. This is because the use of a toner having a high sphericity and a small particle diameter makes it possible to form a uniformly thin toner layer on a photoreceptor.

The inventors further found that the use of a spherically particulate toner having a particle size distribution such that the ratio of 50%-volume particle diameter/50%-number particle diameter is not more than 1.25 and the square root of the ratio of 84%-volume particle diameter/16%-volume particle diameter is not more than 1.25 makes it possible to further improve image quality.

It was further found that the use of the foregoing spherically particulate toner comprising hydrophobic silica and hydrophobic titanium oxide externally added thereto in combination makes it possible to further improve the properties of developer. This is because the use of such a toner makes it possible to remarkably improve basic characteristics of toner such as triboelectricity and fluidity.

The inventors further found that the use of a spherically particulate toner obtained by a process which comprises mixing a mixture comprising a colorant and a water-insoluble binder resin as essential components and an aqueous medium (water or liquid medium comprising water as a major component), emulsifying the mixture to form spherical colored particles, and then withdrawing the said particles dispersed in the liquid medium in the form of dried powder or a process which comprises allowing a polymerizable monomer having a colorant dispersed therein to undergo polymerization in a liquid medium to form spherical colored particles, and then withdrawing the said particles dispersed in the liquid medium in the form of dried powder makes it possible to easily obtain a particulate toner adapted for the electrostatic image developer of the present invention.

The inventors further found that as the carrier for the developer of the present invention there may be preferably used a spherically or almost spherically particulate carrier having a small particle diameter because the toner used therewith has a small particle diameter. In particular, it was found that a carrier coated with a resin, particularly silicon, having a volume-average particle diameter of from 20 to 150 μm, preferably from 20 to 120 μm, more preferably from 20 to 80 μm is desirable.

The background and detailed description of the present invention will be further described hereinafter.

It is generally said that lithographic printing process provides better image quality than electrophotographic printing process. This is because the ink layer on the printed matter provided by lithographic printing process comprises picture elements having a particle diameter on the order of submicron and thus has a thickness of about 0.5 μm while the toner layer on the printed matter provided by electrophotographic printing process using a powder toner comprises picture elements having a particle diameter of from about 7 to 13 μm and thus has a thickness of from about 10 to 20 μm. From such a standpoint of view, the inventors expected that by drastically reducing the particle diameter of toner in electrostatic image developer from the conventional value and drastically reducing the thickness of the toner layer from the conventional value, the quality of image provided by electrophotographic printing process can be improved close to the level of lithographic printing process.

The inventors then thought that the shape of toner particles is preferably spherical to secure sufficient powder fluidity or triboelectricity even if the toner has a reduced particle diameter. The inventors then studied the composition, properties and preparation process of spherically particulate toner having a small particle diameter. As a result, the inventors found a suitable powder toner and developed a method for the stable production of such a toner. The inventors further found a developer comprising such a toner which can provide a drastic improvement in image quality.

The small particle diameter toner proposed by the inventors has a volume-average particle diameter of from 1 to 6 μm, preferably from 2 to 6 μm, more preferably from 3 to 6 μm, and is spherical. The use of such a toner makes it possible to form a uniformly thin toner layer on the photoreceptor and thus reduce the thickness of the toner layer on the printed matter, resulting in the drastic reduction of the amount of toner to be consumed per sheet of printing paper.

Further, the use of a particulate toner having a roundness as high as not less than 0.97 as calculated in terms of average circularity makes it easier to form a uniformly thin toner layer on the photoreceptor and hence makes it possible to further improve image quality. Moreover, the use of such a particulate toner having a shape close to complete sphere makes it possible to prevent the deterioration of fluidity accompanying the reduction of the particle diameter of the particulate toner.

On the other hand, when the particle diameter of the particulate toner is reduced and the amount of the toner on the printed matter is reduced, the reduction of the image density can easily occur. Thus, it is necessary that the content of colorant in the toner be increased to secure necessary image density.

Thus, in order to obtain sufficient print image density with a toner having a particle diameter as small as from 1 to 6 μm, for which the present invention is intended, it is essential to predetermine the pigment concentration in the toner with a specific range. It may be necessary to predetermine the colorant concentration higher than that of commercially available toners having an ordinary size (from about 7 to 13 μm).

The powder toner having a particle diameter of from 1 μm to 6 μm of the present invention, if it is a black toner comprising carbon black incorporated therein as a colorant, needs to comprise carbon black incorporated therein in an amount of not less than 8% by weight, preferably not less than 9% by weight based on the sum of the weight of the binder resin and colorant used. The upper limit of carbon black content is about 20% by weight, preferably about 15% by weight, to maintain sufficient thermal properties such as fixability and good triboelectricity. Further, the color toner comprising an organic pigment incorporated therein as a colorant needs to comprise an organic pigment incorporated therein in an amount of not less than 3% by weight, preferably not less than 4% by weight, more preferably not less than 5% by weight based on the sum of the weight of the binder resin and colorant used. The upper limit of organic pigment content is about 20% by weight, preferably about 10% by weight, to maintain good hue, transparency, fixability and triboelectricity.

The toner binder resin to be used in the present invention is not specifically limited. In practice, however, a styrene (meth)acrylate resin or polyester resin is desirable because it can fully exert the effect of the present invention. The use of a styrene acrylate resin makes it easy to secure an excellent fixability. Further, the use of a polyester resin makes it possible to obtain an excellent color-developability or gloss. The optimum binder resin can be selected depending on the purpose of the developer.

If the particle diameter of powder toner obtained by pulverization process is reduced, the grinding energy cost shows a rapid rise from about 6 μm of the volume-average particle diameter. Further, the resulting toner particles are amorphous and exhibit a deteriorated triboelectricity or powder fluidity. This is a great problem arising when a particulate toner having a particle diameter of not more than about 6 μm is put into practical use.

However, the deterioration of the powder fluidity of a toner due to reduction of particle diameter can be remarkably prevented by making the toner particles spherical. The particulate toner having a particle diameter of from 1 μm to 6 μm, for which the present invention is intended, preferably has an average circularity of not less than 0.97. The average circularity can be determined by taking SEM (scanning type electron microscope) photograph of toner particles, measuring the size of the toner particles on the photograph, and then calculating the average circularity from the measurements. However, it can be easily measured by means of a Type FPIP-1000 flow type particle image analyzer produced by Toa Iyo Denshi K. K.

On the other hand, the inventors conjecture that the deterioration of triboelectricity due to the reduction of particle diameter is mainly attributed to the exposure of a part of the colorant or other additives (normally wax or charge control agent) at the surface of the toner particles. In other words, even if the content (% by weight) of colorant or the like is the same, the reduction of particle diameter causes an increase in the surface of the toner particles and hence an increase in the proportion of colorant exposed at the surface of the toner particles, resulting in a drastic change in the composition of the surface of the toner particles and hence a drastic change in the triboelectricity of the toner particles. Thus, the triboelectricity of the small size toner particles can be difficultly controlled.

In order to keep the triboelectricity of the toner particles good even if the particle diameter of the toner particles is reduced, it is effective to prevent the colorant or other additives from being exposed at the surface of the toner particles, that is, arrange the toner structure such that the colorant or other additives are encapsulated in the toner particles.

Whether or not the colorant, charge control agent, wax or the like are exposed at the surface of the toner particles can be easily judged by observing a section of the toner particle by TEM (transmission type electron microscope). In some detail, the toner particle of the present invention is embedded in a resin. The embedded toner particle is then cut by a microtome. The specimen thus prepared may be dyed with ruthenium oxide or the like if necessary. By observing the section of the particle by TEM, it can be clearly seen whether or not the colorant or other additives are encapsulated in the toner particles.

Theoretically speaking, the spherically particulate toner having a particle diameter of from 1 to 6 μm comprising a colorant encapsulated in toner particles can be obtained, e.g., by subjecting amorphous particles prepared by pulverization process to surface treatment with a resin so that they are rendered spherical. In practice, however, a wet process such as polymerization process and emulsification process can be actually employed to advantage from the standpoint of ease of production and cost. In particular, emulsification process is suitable for the preparation of the particulate toner of the present invention because even if the kind of binder resin to be used is varied, spherical colored particles having a good particle size distribution can be formed and the pigment concentration can be easily raised.

The use of such a process makes it easier to give a sharp toner particle diameter distribution as described below. The resulting toner can exert a higher effect of improving the image quality.

The particle size distribution of the toner particles, too, has an effect on the triboelectricity of the toner. In particular, the small particle diameter toner to be used in the present invention preferably has a sharper particle size distribution than commercially available toners having a particle diameter of from about 7 $\mu$m to 13 $\mu$m. In other words, the powder toner having a volume-average particle diameter of from 1 $\mu$m to 6 $\mu$m, for which the present invention is intended, must satisfy the requirements that it has a particle size distribution such that, as measured by Coulter Multisizer, the ratio of 50%-volume particle diameter/50%-number particle diameter is not more than 1.25, particularly not more than 1.20 and the square root of the ratio of 84%-volume particle diameter/16%-volume particle diameter is not more than 1.25, particularly not more than 1.20, to exhibit a good triboelectricity and hence provide a high quality printed image free of fog.

Further, also by properly selecting the kind or amount of the inorganic oxide fine particles to be attached to the surface of the toner particles, the triboelectricity and powder fluidity of the small particle diameter toner can be further improved. Examples of the inorganic oxide fine particles employable in the present invention include silica, titanium oxide, aluminum oxide, zinc oxide, tin oxide, antimony oxide and magnesium oxide having a primary particle diameter of from 5 to 100 $\mu$m. These inorganic oxide fine particles may be used singly or in combination. These inorganic oxide fine particles may be previously treated with an inorganic material such as particulate titanium oxide doped with tin oxide antimony to provide electrical conductivity.

Particularly preferred among these inorganic oxide fine particles are hydrophobicized silica and titanium oxide having a primary particle diameter of from about 5 nm to 50 nm to be used in combination for negatively polar toner. Many kinds of hydrophobic silica for toner have been commercially available. It is practically advantageous that any desirable silica are selected from these commercial products.

As hydrophobic titanium oxide there may be preferably titanium oxide surface-treated with a trifluoromethyl group-containing organic compound particularly for negatively polar toner from the standpoint of environmental stability of triboelectricity and charge rising properties (rate at which saturated triboelectricity is reached and uniformity in triboelectricity).

The trifluoromethyl group-containing organic compound is an organic compound (including polymer) containing at least —$CF_3$ group in its molecular structure. Preferred examples of such an organic compound include perfluoroalkyl acrylate resin, and alkoxysilane compound, alkylsilane compound and chlorosilane compound containing perfluoroalkyl group. Examples of such a compound will be given below.

$CF_3—(CH_2)_9—Si(OCH_3)_3$ $CF_3—(CH_2)_2—Si(OCH_3)_3$ $CF_3—(CF_2)_7—(CH_2)_2—Si(OCH_3)_3$ $CF_3—(CF_2)_7—(CH_2)_2—Si(CH_3)\ (OCH_3)_2$ $CF_3—(CF_2)_7—(CH_2)_2—Si(CH_3)_3$ $CF_3—(CF_2)_7—(CH_2)_2—SiCl_3$ $CF_3—(CF_2)_7—SO_2NH(CH_2)_3NH_2$

A specific example of commercially available product is Disguard NH-15 (toluene dispersion of $CF_3—(CF_2)_7$-group-containing acrylate resin produced by DAINIPPON INK & CHEMICALS, INC.).

The surface treatment of titanium oxide fine particles with such a trifluoromethyl group-containing organic compound can be accomplished, e.g., by a process which comprises dissolving the organic compound in an organic solvent such as toluene and alcoholic solvent, thoroughly mixing the solution with particulate titanium oxide, removing the organic solvent from the mixture by distillation or the like, subjecting the mixture to heat treatment, and then grinding the material.

The amount of such a trifluoromethyl group-containing organic compound to be surface-treated to the metal oxide fine particles is preferably from about 5 to 30% by weight based on the weight of the metal oxide fine particles. If the externally added amount of the metal oxide fine particles remains the same, the triboelectricity of the toner tends to increase with the increase in the amount of the organic compound to be surface-treated to the metal oxide fine particles. It is preferred that the amount of the trifluoromethyl group-containing organic compound to be surface-treated be adjusted depending on the purpose.

The trifluoromethyl group-containing organic compound has an extremely low surface energy due to its trifluoromethyl group and thus exhibits a strong water repellency and a great electronegativity when rubbed. Thus, the trifluoromethyl group-containing organic compound can exert an effect of remarkably enhancing the negative triboelectricity of the toner. Accordingly, the toner comprising titanium oxide fine particles surface-treated with a trifluoromethyl group-containing organic compound externally added thereto exhibits drastically improved environmental stability and charge rising properties.

The added amount of such inorganic oxide fine particles depends on the purpose of the powder toner. In general, the smaller the toner particle diameter is, the greater is preferably the added amount of the inorganic oxide fine particles. The particulate toner of the present invention having a particle diameter of from 1 to 6 $\mu$m preferably comprises various oxides externally added thereto in an amount of from 0.3 to 3% by weight based on the weight of the particulate toner.

The external addition of such inorganic oxide fine particles is not specifically limited but can be accomplished by a known conventional method using a Henschel mixer, a Hybridizer, et al. For example, a two-stage process may be employed which comprises external addition of inorganic oxide fine particles treated with a trifluoromethyl group-containing organic compound and subsequent external addition of hydrophobic silica fine particles. Alternatively, a process which comprises external addition of a mixture of the titanium oxide fine particles and the hydrophobic silica fine particles may be used.

The use of the foregoing developer comprising in combination a spherically particulate toner having a volume-average particle diameter of from 1 to 6 $\mu$m and a predetermined range of colorant concentration (preferably having a predetermined range of particle size distribution and comprising a hydrophobic inorganic oxide externally added thereto) and a resin-coated carrier having a particle diameter of from 20 to 150 μm makes it possible to exert a remarkable effect of not only improving image quality but also drastically reducing the amount of toner to be consumed per sheet of printing paper. It can exert a remarkable effect of improving image quality particularly for the development of full-color image with four color developers (cyan, magenta, yellow, black).

Preferred composition and preparation process of the toner to be used in the image formation process of the present invention will be further described hereinafter.

The colorant to be incorporated in the powder toner of the present invention is not specifically limited. In practice, however, any colorant which has heretofore been used for electrophotographic toner may be used. Preferred among these colorants are pigments. Examples of these pigments will be given below.

As a pigment for black toner there may be used carbon black, magnetic material or pigment prepared by processing the following organic chromatic pigments so that they are rendered black. However, carbon black is preferred.

Examples of pigment for yellow toner include azo pigments (C. I. Pigment Yellow 1, 3, 17, 74, 81, 83, 93, 94, 95, 128), isoindolinone pigments (C. I. Pigment Yellow 109, 110), and anthraquinone pigments (C. I. Pigment Yellow 147).

Examples of pigment for magenta toner include quinacridone pigments (C. I. Pigment Red 202, 206, 207, C. I. Pigment Violet 19), azo pigments (C. I. Pigment Red 2, 4, 5, 23, 38, 48, 57, 63, 166, 112, 144, 185, 213, 220, 221) anthraquinone pigments (C. I. Pigment Red 177), perylene pigments (C. I. Pigment Red 224), thioindigoid pigments (C. I. Pigment Red 88), diketopyrrolopyrole pigments (C. I. Pigment Red 254), and dioxazine pigments (C. I. Pigment Violet 37).

Examples of pigment for cyan toner include phthalocyanine pigments (C. I. Pigment Blue 15, 15:1, 15:2, 15:3, 15:4, C. I. Pigment Green 7), anthraquinone pigments (C. I. Pigment Blue 60), indigo pigments (C. I. Pigment Blue 66), and base dye lake pigments (C. I. Pigment Blue 1, 62).

An emulsification process for the preparation of a particulate toner to be used in the present invention will be described hereinafter. In some detail, a mixture comprising a colorant and a water-insoluble binder resin as essential components and an aqueous medium are mixed and emulsified to form spherical colored resin particles. The particles dispersed in the aqueous medium are then withdrawn in the form of dried powder. If necessary, the particles are then classified to adjust the particle size distribution thereof. Thus, the desired particulate toner is obtained.

The mixture of colorant and binder resin may be prepared by using an organic solvent as described in JP-A-5-66600 or by hot-melting these colorant and binder resin without organic solvent to make a solution as described in JP-A-09-311502.

Examples of suitable organic solvent, if used, include hydrocarbons such as pentane, hexane, heptane, benzene, toluene, xylene, cyclohexane and petroleum ether; halogenated hydrocarbons such as methylene chloride, chloroform, dichloroethane, dichloroethylene, trichloroethane, trichloroethylene and carbon tetrachloride; alcohols such as methanol, ethanol, isopropyl alcohol, n-propyl alcohol and butanol; ketones such as acetone, methyl ethyl ketone and methyl isobutyl ketone; and esters such as ethyl acetate and butyl acetate. Two or more of these organic solvents may be used in admixture.

The foregoing binder resin to be used herein is not specifically limited so far as it is soluble in the foregoing organic solvent or hot-melted. In practice, however, a water-insoluble resin which cannot itself be dispersed in an aqueous medium but can be dispersed in an aqueous medium only in the presence of an emulsifying agent or dispersion stabilizer or a self-water dispersible water-insoluble resin which can itself be dispersed in an aqueous medium may be used.

Examples of such a water-insoluble resin for toner include styrene resin, (meth)acrylic resin, polyester resin, polyurethane resin, and epoxy resin. Particularly preferred among these water-insoluble resins is styrene (meth)acrylate resin obtained by the polymerization of a styrene monomer and a (meth)acrylic acid ester as essential components. Examples of (meth)acryl employable herein include methacryl and acryl.

As the foregoing resin there may be preferably used one having a normal weight-average molecular weight of from 3,000 to 300,000, which level is required for the realization of a sufficient mechanical strength, and a glass transition temperature of from 50° C. to 100° C.

Among the foregoing binder resins, the self-water dispersible resin means a resin containing a functional group that can be rendered anionic upon neutralization which can form a stable water dispersion under the action of an aqueous medium free from emulsifying agent or dispersion stabilizer when the functional group that can be rendered hydrophilic is partly or entirely neutralized with a base.

Examples of the functional group which can be rendered hydrophilic upon neutralization include acidic groups such as carboxyl group, phosphoric acid group and sulfonic acid group. Examples of the resin containing such a functional group include styrene resin, (meth)acrylic resin, polyester resin, polyurethane resin, and epoxy resin. Preferred among these resins is styrene (meth)acrylate resin containing an acidic group.

As a suitable anionic styrene (meth)acrylate resin which can be rendered self-water dispersible upon neutralization there may be used one obtained by the radical polymerization of a styrene monomer such as (meth)acrylic polymerizable vinyl monomer containing an acid group as an essential component with a polymerizable vinyl monomer other than the polymerizable vinyl monomer containing an acid group such as (meth)acrylic acid ester in the presence of a radical polymerization initiator. The polymerization reaction for this purpose can be effected properly in the form of solution polymerization, suspension polymerization or emulsion polymerization.

Examples of such an acid group-containing (meth)acrylic polymerizable monomer include acrylic acid, methacrylic acid, crotonic acid, itaconic acid, maleic acid, fumaric acid, monobutyl itaconate, and monobutyl maleate.

Examples of the polymerizable monomer other than acid group-containing polymerizable monomer employable herein include:

(1) Styrenic monomers: styrene, vinyl toluene, 2-methylstyrene, t-butylstyrene, chlorostyrene;

(2) Acrylic acid ester: methyl acrylate, ethyl acrylate, isopropyl acrylate, n-butyl acrylate, isobutyl acrylate, n-amyl acrylate, isoamyl acrylate, n-hexyl acrylate, 2-ethylhexyl acrylate, n-octyl acrylate, decyl acrylate, dodecyl acrylate, 2-chloroethyl acrylate, phenyl acrylate, methyl alfachloroacrylate;

(3) Methacrylic acid ester: methyl methacrylate, propyl methacrylate, n-butyl methacrylate, isobutyl methacrylate, n-amyl methacrylate, n-hexyl methacrylate, 2-ethylhexyl methacrylate, n-octyl methacrylate, decyl methacrylate, dodecyl methacrylate, 2-chloroethyl methacrylate, phenyl methacrylate, methyl alphachloromethacrylate;

(4) Acrylic acid or methacrylic acid derivatives: acrylonitrile, methacrylonitrile, acrylamide:

(5) Vinyl ethers: vinyl methyl ether, vinyl ethyl ether, vinyl isobutyl ether;

(6) Vinyl ketones: vinyl methyl ketone, vinyl hexyl ketone, methyl isopropenyl ketone; and (7) N-vinyl compounds: N-vinylpyrrole, N-vinylcarbazole, N-vinylindole, N-vinylpyrrolidone.

For the preparation of the resin which can be rendered self-water dispersible upon neutralization, a general-purpose organic solvent may be used if solution polymerization is effected. Specific examples of such an organic solvent include so-called inert solvents such as various aromatic hydrocarbons (e.g., toluene, xylene, benzene), various alcohols (e.g., methanol, ethanol, propanol, butanol), various ether alcohols (e.g., cellosolve, carbitol), various ketones (e.g., acetone, methyl ethyl ketone, methyl isobutyl ketone), various esters (e.g, ethyl acetate, butyl acetate) and various ether esters (e.g., butyl cellosolve acetate).

As the polymerization initiator to be used herein there may be used any known commonly used organic peroxide initiator or azo initiator. Specific examples of these initiators include peroxides such as benzoyl peroxide, cumene hydroperoxide, t-butyl hydroperoxide, sodium persulfate and ammonium persulfate, and azo compounds such as azobisobutylonitrile and azobisisovaleronitrile.

The content of carboxyl group in the carboxyl group-containing anionic resin which can be rendered hydrophilic upon neutralization is not specifically limited. If the carboxyl group-containing anionic resin is a styrenic resin, (meth)acrylic resin or suitable styrene (meth)acrylate resin, it preferably has an acid value (mg of KOH required to neutralize 1 g of resin) of from 30 to 150.

As the toner binder resin to be used in the present invention there may be used any known conventional polyester resin. As such a polyester resin there may be used one obtained by the reaction of a polyhydric alcohol with a polybasic acid or ester-forming derivative thereof.

The polyester resin which can be preferably used aherein can be prepared by the dehydropolycondensatiqn of a polybasic acid with a polyhydric alcohol as starting materials in the presence of a catalyst in the presence or absence of solvent. The polybasic acid may be partly subjected to demethanolization polycondensation with its methylesterification product thereof as one of its ester-forming derivatives.

More specifically, an aromatic polyester resin obtained by the reaction of an aromatic dicarboxylic acid such as phthalic acid or its ester-forming derivative as an essential component is preferred. The emulsification process may be effected using a binder resin soluble in the solvent used.

Examples of the polybasic acid employable herein include aromatic carboxylic acids such as terephthalic acid, isophthalic acid, phthalicanhydride, trimelliticanhydride, pyromellitic acid and naphthalenedicarboxylic acid, aliphatic carboxylic acids such as maleic anhydride, fumaric acid, succinic acid, alkenyl succinic anhydride and adipic acid, and alicyclic carboxylic acids such as cyclohexane dicarboxylic acid. These polybasic acids may be used singly or in combination.

Examples of the polyhydric alcohol employable herein include aliphatic diols such as ethylene glycol, propylene glycol, butanediol, hexanediol, neopentyl glycol and glycerin, alicyclic diols such as cyclohexanediol, cyclohexane dimethanol and hydrogenated bisphenol A, and aromatic diols such as ethylene oxide adduct of bisphenol A and propylene oxide adduct of bisphenol A. These polyhydric alcohols may be used singly or in combination.

The glass transition point of the polyester resin is preferably from 50° C. to 75° C., more preferably from 55° C. to 70° C. If the glass transition point of the polyester resin falls below 50° C., the resulting toner exhibits an insufficient resistance to thermal cohesiveness. On the contrary, if the glass transition point of the polyester resin exceeds 75° C., the resulting toner exhibits a deteriorated fixability to disadvantage.

The acid group content in the polyester resin can be properly adjusted by selecting the mixing proportion and percent conversion of the foregoing polybasic acid and polyhydric alcohol so that the carboxyl group by which the polyester is terminated is controlled. Alternatively, trimellitic anhydride can be used as a polybasic acid component to obtain a polyester resin comprising a carboxyl group incorporated in its main chain. In the toner of the present invention, the polyester resin preferably has an acid value of from 1 to 30.

The basic neutralizing agent for rendering the foregoing acid group-containing styrene (meth)acrylate resin or polyester resin self-water dispersible is not specifically limited. In practice, however, an inorganic alkali such as sodium hydroxide, potassium hydroxide, lithium hydroxide, calcium hydroxide, sodium carbonate and ammonia or an organic base such as diethylamine, triethylamine and isoproplylamine may be used.

If as a water-insoluble resin to be used as a binder resin there is used a non-self-water dispersible resin which is not dispersed in water itself as mentioned above, it is necessary that the resin solution and/or aqueous medium to be mixed therewith (The term "aqueous medium" as used is meant to indicate water or a liquid medium mainly composed of water) be used in admixture with an emulsifier and/or dispersion stabilizer.

As the dispersion stabilizer there is preferably used a water-soluble polymer compound. Examples of such a water-soluble polymer compound include polyvinyl alcohol, polyvinyl pyrrolidone, hydroxyethyl cellulose, and carboxymethyl cellulose. Examples of the emulsifier employable herein include nonionic surface active agents such as polyoxyethylene alkyl phenol ether, anionic surface active agents such as sodium alkylbenzenesulfonate, and cationic surface active agents. Of course, two or more of these emulsifiers may be used in combination. Alternatively, two or more of these dispersion stabilizers may be used in combination. Emulsifiers and dispersion stabilizers may be used in combination. In general, however, a dispersion stabilizer is mainly used in combination with an emulsifier.

The emulsifier or dispersion stabilizer, if any, is preferably used in a concentration of from about 0.5 to 3% by weight based on the weight of the aqueous medium.

Even if the foregoing resin which can be rendered self-water dispersible upon neutralization is used, an emulsifier and/or dispersion stabilizer may be used as necessary so far as it doesn't impair the effect of the present invention.

If necessary, the spherically particulate colored resin for which the present invention is intended may comprise a charge control agent such as metal-containing azo compound and salicylic metal complex or a wax such as polyethylene wax, polypropylene wax and paraffin wax incorporated therein in an amount of from 0.1 to 10% by weight based on the weight of the binder resin used.

The incorporation of these additives or the foregoing colorant, if an organic solvent is used, can be accomplished by the addition of these additives to an organic solvent solution of the binder resin which is then subjected to grinding and mixing thoroughly by an ordinary mixer or disperser such as ball mill and continuous bead mill. If no organic solvent is used, it may be accomplished by thoroughly kneading the binder resin, colorant, additives, etc. by means of a kneader, two-roll mill or twin-screw extruder.

The dispersion of spherical colored resin particles thus obtained by emulsification, if an organic solvent is used, is then subjected to distillation or the like so that the organic solvent is removed therefrom. The resulting aqueous dispersion is then filtered off by filtration or other means. The particles thus obtained are then dried to obtain a particulate toner. The colored resin particles obtained with an emulsifier or dispersion stabilizer is preferably washed more thoroughly before use.

In the case where resin particles are obtained with a self-water dispersible resin obtained by neutralizing an acid group-containing water-insoluble resin with a basic neutralizing agent as a binder resin, the particles which have been freed of organic solvent is of course preferably subjected to neutralization of the hydrophilic group on the surface thereof which has been neutralized with the basic neutralizing agent back to the original functional group with an acidic neutralizing agent such as hydrochloric acid, sulfuric acid, phosphoric acid, acetic acid and oxalic acid so that the hydrophilicity thereof is further lowered before filtration and drying.

Drying can be accomplished by any known commonly used method. For example, the toner particles may be dried under normal or reduced pressure at a temperature such that the toner particles are not heat-fused or agglomerated. Alternatively, the toner particles may be subjected to freeze-drying. Further, a spray drier may be used to dry the toner particles while separating them from the aqueous medium. A method which comprises stirring the powder under reduced pressure while heating at a temperature such that the toner particles are not heat-fused or a method which comprises drying in a heated air flow is efficient and desirable.

In the case where classification for removing coarse particles or fine particles is needed to unify the particle size distribution of the particulate toner, any known commonly used method using an ordinary commercially available dry classifier for toner or other purposes may be used. Alternatively, a method may be used involving classification of an aqueous slurry of spherical colored particles using the difference of sedimentation rate by particle diameter. The removal of coarse particles may be accomplished also by filtration of an aqueous slurry of spherical colored particles through a filter.

A polymerization process for the preparation of a particulate toner to be used in the present invention will be described hereinafter. This process involves polymerization of a polymerizable monomer having a colorant dispersed therein in a liquid medium to form colored resin particles, followed by the withdrawal of the particles dispersed in the liquid medium in the form of dried powder which is then optionally subjected to classification to obtain a spherically particulate toner having a unified particle size distribution.

In some detail, a colorant and a reactive monomer capable of forming a binder resin are suspended or emulsion-dispersed in a liquid medium in the presence of a dispersion stabilizer or emulsifier. The suspension or dispersion thus formed is then subjected to polymerization reaction by radical polymerization with stirring in the presence of a polymerization initiator to obtain an aqueous dispersion of spherical toner particles having a colorant encapsulated in a binder resin.

Specific examples of the foregoing radically polymerizable monomer employable herein include acryl monomers such as styrene (e.g., styrene, α-methylstyrene, chlorostyrene, vinylstyrene), monoolefin (e.g., ethylene, propylene, butylene, isobutylene), vinyl ester (e.g., vinyl acetate, vinyl propionate, vinyl butyrate, vinyl benzoate), α-methylenealiphatic monocarboxylic acid ester (e.g., methyl acrylate, ethyl acrylate, butyl acrylate, octyl acrylate, dodecyl acrylate, phenyl acrylate, methyl methacrylate, ethyl methacrylate, butyl methacrylate, dodecyl methacrylate), glycolmono(meth)acrylic acid ester (e.g., ethyleneglycol monoacrylate, propyleneglycol monoacrylate, tetramethylene ether glycol monoacrylate), vinyl ether (e.g., vinyl methyl ether, vinyl ethyl ether, vinyl butyl ether), and vinyl ketone (e.g., vinyl methyl ketone, vinyl hexyl ketone, vinyl propenyl ketone). These radical-polymerizable monomers may be used singly or in combination.

The monomer composition constituting the binder resin is prepared such that the resulting polymer exhibits a glass transition temperature of from 50° C. to 80° C.

If necessary, these monomers may be used in combination with a small amount of a reactive monomer having two or more ethylenically unsaturated double bonds. Examples of such a reactive monomer having two or more ethylenically unsaturated double bonds include conjugated diene such as butadiene and isoprene, divinyl benzene, di(meth)acrylate of bisphenol A-alkylene oxide adduct, trimethylolpropane tri (meth)acrylate, and pentaerythritol tetra(meth)acrylate.

As the polymerization initiator for use in the preparation of such a resin there may be, of course, used any ordinary oil-soluble or water-soluble polymerization initiator. Examples of such an oil-soluble or water-soluble polymerization initiator include various peroxides such as benzoyl peroxide, di-t-butyl peroxide, cumene hydroperoxide, t-butyl peroxide and 2-ethyl hexanoate, and various azo compounds such as azobisisobutylonitrile and azobisisovaleronitrile.

For suspension polymerization, a polymerization initiator insoluble in the liquid medium used but soluble in the monomer used may be selected as an essential initiator. For emulsion polymerization, a water-soluble polymerization initiator may be selected as an essential initiator. The amount of the polymerization initiator to be used is not specifically limited. In practice, however, it may be from 0.01 to 5 parts by weight based on 100 parts by weight of all the reactive monomers used.

The binder resin formed by polymerization may be arbitrarily adjusted by polymerization conditions or the like. Preferably, the binder resin is adjusted to have a weight-average molecular weight of from 10,000 to 500,000.

As the colorant, charge control agent and wax to be incorporated in the particulate toner there may be used any known commonly used materials similarly to the foregoing emulsion process toner.

As the dispersion stabilizer to be used in suspension polymerization there may be normally used a water-soluble polymer compound. Examples of such a water-soluble polymer compound include polyvinyl alcohol, polyvinyl pyrrolidone, hydroxyethyl cellulose, carboxylmethyl cellulose, cellulose gum, and so on.

Further, a water-insoluble inorganic fine powder material having a particle diameter of from 0.01 to 5 μm, too, may be used as a suspension dispersion stabilizer. Examples of such a material include tricalcium phosphate, talc, bentonite, kaolin, titaniumoxide, alumina, zincwhite, aluminum hydroxide, magnesium hydroxide, basic magnesium silicate, titanium hydroxide, ferric hydroxide, barium sulfate, silica, magnesium carbonate, and calcium carbonate.

These dispersion stabilizers may be used singly or in combination. The amount of such a dispersion stabilizer to be used is normally from 0.1 to 10 parts by weight based on 100 parts by weight of all the reactive monomers.

Examples of the emulsifying agent to be used in emulsion polymerization include anionic surface active agents such as sodium dodecylbenzenesulfonate, sodium laurylsulfate and sodium dodecyldiphenyloxidedisulfonate, and nonionic surface active agents such as polyoxyethylene lauryl ether and polyoxyethylene nonyl phenol ether. These emulsifying agents may be used singly or in combination. The amount of the emulsifying agent to be used is normally from 0.01 to 5 parts by weight based on 100 parts by weight of all the reactive monomers.

For suspension polymerization, the dispersion stabilizer may be used in combination with a small amount of an emulsifying agent. Alternatively, for emulsion polymerization, the emulsifying agent may be used in combination with a small amount of a dispersion stabilizer. The foregoing dispersion stabilizer or emulsifying agent may be replaced by a self-emulsifiable epoxy resin or self-emulsifiable polyurethane resin.

The foregoing polymerizable monomer, colorant, dispersion stabilizer, liquid medium and polymerization initiator may be simultaneously added and stirred to polymerize monomer droplets. Alternatively, the polymerizable monomer and colorant may be thoroughly mixed by means of, for example, ball mill or colloid mill, and then added to a liquid medium containing a polymerization initiator and a dispersion stabilizer. The mixture is then stirred by a homogenizer, rotor stator type mixer, static mixer or the like so that droplets of the monomer comprising a polymerizable monomer as essential component is suspended in a liquid medium. The mixture is further stirred to undergo polymerization until a particulate toner having a predetermined particle diameter is formed.

Examples of the liquid medium to be used in polymerization include water such as distilled water and ion-exchanged water, various aromatic hydrocarbons such as toluene, xylene and benzene, various alcohols such as methanol, ethanol, propanol and butanol, various alcohols such as cellosolve and carbitol, various ketones such as acetone, methyl ethyl ketone and methyl isobutyl ketone, various esters such as ethyl acetate and butyl acetate, and various ether esters such as butyl cellosolve acetate.

In any of the foregoing polymerization processes, core-shell polymerization, power feed polymerization or graft polymerization may be employed to vary the chemical structure or layer structure of the particles. The reaction conditions under which the foregoing various suspension polymerization and emulsion polymerization processes of the present invention are effected are not specifically limited. In any of these polymerization processes, the reaction may be normally effected at a temperature of from room temperature to 80° C. for 15 minutes to 24 hours.

The dispersion of spherically particulate colored resin thus obtained may be then freed of liquid medium and dried to easily obtain a spherically particulate colored resin in the form of powder. In order to remove the dispersion stabilizer or emulsifying agent from the dispersion, it is preferred that the dispersion be repeatedly washed. The removal of liquid medium and drying may be accomplished by the filtration of the spherically particulate colored resin followed by drying in the same manner as emulsification process for the preparation of particulate toner.

In order to unify the particle size distribution of toner particles, classification may be effected in the same manner as for emulsification process toner as necessary.

The spherically particulate toner having a volume-average particle diameter of from 1 to 6 μm thus obtained may then be mixed with a resin-coated carrier having a volume-average particle diameter of from 20 to 150 μm to obtain the electrostatic image developer according to the present invention.

As the carrier to be used in the present invention there may be used any of iron powder, ferrite and magnetite which may be coated with various resins, and composite carrier comprising a resin and a magnetic powder. The developer comprising a small particle diameter toner as in the present invention can comprise a small particle diameter resin-coated carrier having a particle diameter of from 20 to 150 μm, preferably from 20 to 120 μm, more preferably from 20 to 80 μm incorporated therein to provide a good image quality to advantage.

As the resin with which the carrier is coated there may be used an acrylic resin, acryl-styrene resin, silicon resin, and fluororesin, singly or in combination. These resins are commercially available in the form of combination with a silane coupling agent or the like. In the present invention, the coating resin is preferably selected from these compounds depending on the purpose of the developer.

A developer comprising a spherically particulate negatively polar toner having a volume-average particle diameter of from 1 to 6 μm comprising hydrophobic silica and hydrophobic titanium oxide externally added thereto and an almost spherically particulate silicon resin-coated carrier having a volume-average particle diameter of from 20 to 150 μm is remarkably desirable in the present invention.

[Embodiments of implication of the Invention]

The present invention can be implemented in the following embodiments:

1. An electrostatic image developer comprising a spherically particulate black toner containing a binder resin and a colorant and a resin-coated carrier, characterized in that said spherically particulate toner has a volume-average particle diameter of from 1 to 6 μm, said colorant is carbon black, the content of which is from 8 to 20% by weight based on the sum of the weight of said binder resin and said colorant and said carrier has a volume-average particle diameter of from 20 to 150 μm.
2. The electrostatic image developer according to Clause 1, wherein said colorant is encapsulated in said binder resin and said spherically particulate toner has an average circularity of not less than 0.97.
3. The electrostatic image developer according to Clause 1 or 2, wherein said spherically particulate toner has a particle size distribution such that the ratio of 50%-volume particle diameter/50%-number particle diameter is not more than 1.25 and the square root of the ratio of 84%-volume particle diameter/16%-volume particle diameter is not more than 1.25.
4. The electrostatic image developer according to Clause 1 or 2, wherein said binder resin for said spherically particulate toner is a polyester resin.
5. The electrostatic image developer according to Clause 1 or 2, wherein said spherically particulate toner is a negatively polar toner comprising a hydrophobic silica and a hydrophobic titanium oxide externally added thereto.
6. The electrostatic image developer according to Clause 1 or 2, wherein said spherically particulate toner is a particulate toner obtained by a process which comprises mixing a mixture comprising a colorant and a water-insoluble binder resin as essential components and an aqueous medium, emulsifying the mixture to form spherical colored particles, and then withdrawing the said particles dispersed in the liquid medium in the form of dried powder.

7. The electrostatic image developer according to Clause 1 or 2, wherein said spherically particulate is a particulate toner obtained by a process which comprises allowing a polymerizable monomer having a colorant dispersed therein to undergo polymerization in a liquid medium to form spherical colored particles, and then withdrawing the said particles dispersed in the liquid medium in the form of dried powder.
8. An electrostatic image developer comprising a spherically particulate color toner containing a binder resin and a colorant and a resin-coated carrier, characterized in that said spherically particulate toner has a volume-average particle diameter of from 1 to 6 $\mu$m, said colorant is an organic pigment, the content of which is from 3 to 20% by weight based on the sum of the weight of said binder resin and said colorant and said carrier has a volume-average particle diameter of from 20 to 150 $\mu$m.
9. The electrostatic image developer according to Clause 8, wherein said colorant is encapsulated in said binder resin and said spherically particulate toner has an average circularity of not less than 0.97.
10. The electrostatic image developer according to Clause 8 or 9, wherein said spherically particulate toner has a particle size distribution such that the ratio of 50%-volume particle diameter/50%-number particle diameter is not more than 1.25 and the square root of the ratio of 84%-volume particle diameter/16%-volume particle diameter is not more than 1.25.
11. The electrostatic image developer according to Clause 8 or 9, wherein said binder resin for said spherically particulate toner is a polyester resin.
12. The electrostatic image developer according to Clause 8 or 9, wherein said spherically particulate toner is a negatively polar toner comprising a hydrophobic silica and a hydrophobic titanium oxide externally added thereto.
13. The electrostatic image developer according to Clause 8 or 9, wherein said spherically particulate toner is a particulate toner obtained by a process which comprises mixing a mixture comprising a colorant and a water-insoluble binder resin as essential components and an aqueous medium, emulsifying the mixture to form spherical colored particles, and then withdrawing the said particles dispersed in the liquid medium in the form of dried powder.
14. The electrostatic image developer according to Clause 8 or 9, wherein said spherically particulate is a particulate toner obtained by a process which comprises allowing a polymerizable monomer having a colorant dispersed therein to undergo polymerization in a liquid medium to form spherical colored particles, and then withdrawing the said particles dispersed in the liquid medium in the form of dried powder.
15. The electrostatic image developer according to Clause 1 or 8, wherein said resin-coated carrier is an almost spherically resin-coated carrier coated with a silicon resin.

EXAMPLES

The present invention will be further described in the following reference examples, examples and comparative examples. The "parts" and "%" as used hereinafter are all by weight. The term "water" as used hereinafter is meant to indicate deionized water.

Reference Example 1

Example of Synthesis of Carboxyl Group-containing Styrene-acryl Resin 667 parts of methyl ethyl ketone were charged into a 3 L flask equipped with a dropping apparatus, a thermometer, a nitrogen gas intake pipe, an agitator and a ref lux condenser. The reaction material was heated to a temperature of 80° C. To the reaction material was then added dropwise a mixture having the following monomers and polymerization initiator in about 2 hours. This reaction was effected in a flow of nitrogen.

| | |
|---|---|
| Styrene | 668 parts |
| Butyl acrylate | 223 parts |
| Acrylic acid | 109 parts |
| Perbutyl O | 50 parts |

After the termination of the dropwise addition, 3 parts of Perbutyl O (radical polymerization initiator produced by NOF Corp.) were added to the mixture every 3 hours three times in all. The reaction further continued for 4 hours. Thereafter, the reaction mixture was freed of solvent to obtain a solid resin (R-1). The resin thus obtained exhibited a glass transition temperature of 72° C., a weight-average molecular weight of 20, 000 and an acid value of 81.

Reference Example 2

Example of Synthesis of Carboxyl Group-containing Styrene-acryl Resin

A 114/12/24 (by parts) mixture of methyl ethyl ketone, isopropyl alcohol and water was charged into a 3 L flask equipped with a dropping apparatus, a thermometer, a nitrogen gas intake pipe, an agitator and a reflux condenser. The reaction material was heated to a temperature of 80° C. To the reaction material was then added dropwise a mixture having the following monomers and polymerization initiator according to Composition 1 below at once. The reaction was then initiated.

Composition 1

| | |
|---|---|
| Styrene | 330 parts |
| Butyl acrylate | 216 parts |
| Acrylic acid | 54 parts |
| Perbutyl O | 0.6 parts |

Subsequently, every 1 hour after 3 hours, the reaction resin solution was sampled in an amount of about 10 parts, diluted with the same amount of methyl ethyl ketone, and then measured for viscosity by means of a Gardner viscometer. When the viscosity of the sample reached P-Q, to the reaction mixture was then added a 567/63 (by parts) mixture of methyl ethyl ketone and isopropyl alcohol. When the temperature of the reaction mixture reached 80° C., to the reaction mixture was then added dropwise the mixture of Composition 2 in 1 hour. The percent monomer residue was determined by gas chromatography. In this manner, the percent polymerization at the first stage was calculated. The results were 60%.

Composition 2

| | |
|---|---|
| Styrene | 413 parts |
| Butyl acrylate | 133 parts |
| Acrylic acid | 54 parts |
| Perbutyl O | 18 parts |

After the termination of the dropwise addition, 2 parts of Perbutyl O were added to the mixture every 3 hours three times in all. The reaction further continued for 4 hours. Thereafter, the reaction mixture was freed of solvent to obtain a solid resin (R-2). The resin thus obtained exhibited a glass transition temperature of 60° C., a weight-average molecular weight of 115,000 and an acid value of 70.

Toner Preparation Example 1

2,000 parts of resin R-2 and 500 parts of carbon black (ELFTEX 8, produced by Cabot Corp.) were kneaded by means of a kneader for 1 hour. 750 parts of the material thus kneaded, 450 parts of the resin R-2 and 300 parts of the resin R-1 were dissolved in 1,000 parts of methyl ethyl ketone. Subsequently, to the carbon-dispersed resin solution thus obtained were added 150 parts of a Type H808 wax dispersion (produced by Chukyo Yushi Co., Ltd.; wax particle diameter: 0.5 μm; wax content: 30 wt-%). The mixture was then subjected to mixing and dispersion using a Type M-250 Eiger motor mill for 10 minutes. To the dispersion thus obtained was then added methyl ethyl ketone to adjust the nonvolatile content to 53%. Thus, a mill base was prepared.

Subsequently, to 566 parts of the mill base thus prepared were added 48 parts of a 1 N aqueous solution of sodium hydroxide, 58 parts of isopropyl alcohol and 150 parts of water. The mixture was then thoroughly stirred. The reaction mixture was kept at an inner temperature of 30° C. where 43 parts of water were then added thereto with stirring to cause phase inversion emulsification by which resin particles were formed. After 30 minutes, to the resin particles were then added 500 parts of water.

Subsequently, the reaction solution was subjected to distillation under reduced pressure to remove the organic solvent therefrom. The resin particles were then separated from the aqueous medium by filtration. The resin particles thus separated were then dispersed again in water. Subsequently, the dispersion thus obtained was adjusted to a pH value of 2.5 with a 1 N aqueous solution of hydrochloric acid. The dispersion was stirred for 30 minutes, filtered, and then washed with water. The resin particles were separated from the aqueous medium to form a wet cake which was then freeze-dried to obtain black resin particles in the form of powder.

The powder thus obtained was then classified by means of an Elbow Jet classifier (produced by Nittetsu Mining Co., Ltd.) to obtain a particulate toner having a good particle size distribution such that the volume-average particle diameter thereof is 5.0 μm as determined by Coulter Multisizer, the ratio of 50%-volume particle diameter/50%-number particle diameter is 1.12 and the square root of the ratio of 84%-volume particle diameter/16%-volume particle diameter is 1.20. The particulate black resin thus obtained also exhibited an average circularity of 0.989 as determined by a Type FPIP-1000 flow particle image analyzer produced by Toa Iyo Denshi Co., Ltd. The particle was embedded in a resin, cut by a microtome, and then observed at the section by TEM (transmission type electron microscope) As a result, carbon black was found encapsulated and uniformly dispersed in the particle.

To 100 parts of the powder were then externally added 0.5 part of a hydrophobic titanium oxide (primary particle diameter: approx. 15 nm) surface-treated with trifluoropropyl trimethoxysilane by 10 wt-% and 1.0 part of a Type Wacker HDK SLM50650 hydrophobic silica by means of a Henschel mixer to prepare a powder toner 1.

Toner Preparation Example 2

The procedure of Toner Preparation Example 1 was followed except that the content of carbon black was changed to 12%. As a result, a particulate toner having a good particle size distribution such that the volume-average particle diameter thereof is 4.1 μm as determined by Coulter Multisizer, the ratio of 50%-volume particle diameter/50%-number particle diameter is 1.13 and the square root of the ratio of 84%-volume particle diameter/16%-volume particle diameter is 1.21 was obtained. The resin particles thus obtained also exhibited an average circularity of 0.989. The particle was then observed at a section thereof by TEM. As a result, carbon black was found encapsulated and uniformly dispersed in the particle. To 100 parts of the particulate toner were then externally added the same hydrophobic titanium oxide and hydrophobic silica as used in Toner Preparation Example 1 in an amount of 0.8 part and 2.0 parts, respectively, to prepare a powder toner 2.

Toner Preparation Example 3

The procedure of Toner Preparation Example 1 was followed except that the content of carbon black was changed to 6%. As a result, a particulate toner having a good particle size distribution such that the volume-average particle diameter thereof is 5.0 μm, the ratio of 50%-volume particle diameter/50%-number particle diameter is 1.09 and the square root of the ratio of 84%-volume particle diameter/16%-volume particle diameter is 1.18 was obtained. The resin particles thus obtained also exhibited an average circularity of 0.989. The particle was then observed by TEM. As a result, carbon black was found encapsulated and uniformly dispersed in the particle. To the particulate toner were then externally added the same additives as used in Toner Preparation Example 1 to prepare a powder toner 3.

Toner Preparation Example 4

The procedure of Toner Preparation Example 1 was followed except that 52 parts of a 1 N aqueous solution of sodium hydroxide, 75 parts of isopropyl alcohol and 130 parts of water were added to 566 parts of the mill base which was then thoroughly stirred and kept at an inner temperature of 30° C. where it was then subjected to phase inversion emulsification with stirring while 50 parts of water was being added dropwise thereto. As a result, a particulate toner having a good particle size distribution such that the volume-average particle diameter thereof is 7.8 μm, the ratio of 50%-volume particle diameter/50%-number particle diameter is 1.10 and the square root of the ratio of 84%-volume particle diameter/16%-volume particle diameter is 1.21 was obtained. The particulate toner thus obtained also exhibited an average circularity of 0.989. The particle was then observed at a section thereof by TEM. As a result, carbon black was found encapsulated and uniformly dispersed in the particle.

To 100 parts of the particulate toner were then externally added 0.3 part of the same hydrophobic titanium oxide as used in Toner Preparation Example 1 and 0.5 part of a Type Wacker HDK SLM50650 hydrophobic silica by means of a Henschel mixer to prepare a powder toner 4.

Toner Preparation Example 5

The mill base prepared in Toner Preparation Example 1 was desolvated to form a solid matter. The solid matter thus obtained was crushed, and then classified by means of a dry classifier to obtain an amorphous particulate toner having a particle diameter distribution such that the volume-average particle diameter is 5.3 μm, the ratio of 50%-volume particle diameter/50%-number particle diameter is 1.34 and the square root of the ratio of 84%-volume particle diameter/16%-volume particle diameter is 1.32 and an average circularity of 0.941. To the particulate toner thus obtained were then externally added the same additives as used in Toner Preparation Example 1 to prepare a powder toner 5.

Toner Preparation Example 6

The procedure of Toner Preparation Example 1 was followed except that carbon black was replaced by a Type TONER MAGENTA E-02 quinacridone pigment (produced by Hoechst Inc.), the content of which was 6%. As a result, a particulate toner having a good particle size distribution such that the volume-average particle diameter thereof is 5.1 μm, the ratio of 50%-volume particle diameter/50%-number particle diameter is 1.18 and the square root of the ratio of 84%-volume particle diameter/16%-volume particle diameter is 1.18 was obtained. The particulate toner thus obtained also exhibited an average circularity of 0.988. The particle was then observed at a section thereof by TEM. As a result, the magenta pigment was found encapsulated and uniformly dispersed in the particle. To the spherically resin particles thus obtained were then externally added the same additives as used in Toner Preparation Example 1 to prepare a powder toner 6.

Toner Preparation Example 7

To 1,200 parts of a polyester resin having an acid value of 4 mg·KOH/g, a weight-average molecular weight of 12,000, a glass transition temperature of 61° C. and a melt viscosity of 40,000 poise at 100° C. were added 800 parts of methyl ethyl ketone. The mixture was then subjected to dissolution. To the resulting resin solution were then added 76.5 parts of a Type Ket Blue 123 phthalocyanine pigment (produced by DAINIPPON INK & CHEMICALS, INC.) . The mixture was then stirred until it was thoroughly dispersed. After the termination of dispersion, the mixture was adjusted with methyl ethyl ketone to a solid content of 50%.

Subsequently, to 200 parts of the mixture were added 50 parts of methyl ethyl ketone and 3.5 parts of a 1 N aqueous ammonia. To the mixture were then added 225 parts of water with stirring at once to cause phase inversion emulsification. As a result, a spherically particulate blue resin was formed. To the resin particles were then added 150 parts of water as a diluent and 4 parts of a 1 N aqueous ammonia for increasing dispersion stability.

Subsequently, the resin particles were subjected to distillation under reduced pressure to remove the organic solvent therefrom. To the residue was then added a 1 N aqueous solution of hydrochloric acid to adjust the pH value thereof to 2.5. The material was filtered, and then washed with water to obtain a wet cake which was then heated and dried with stirring under reduced pressure to obtain a spherically particulate blue matter comprising a polyester resin incorporated therein as a binder resin.

The powder thus obtained was then classified to obtain a particulate blue toner having a good particle size distribution such that the volume-average particle diameter thereof is 5.2 μm, the ratio of 50%-volume particle diameter/50%-number particle diameter thereof is 1.11 and the square root of the ratio of 84%-volume particle diameter/16%-volume particle diameter thereof is 1.19. The blue resin particles had an average circularity of 0.990. As a result of observation by TEM, the phthalocyanine pigment was found encapsulated and uniformly dispersed in the particle.

To the particulate toner thus obtained were then externally added the same additives as used in Toner Preparation Example 1 to prepare a powder toner 7.

Toner Preparation Example 8

The procedure of Toner Preparation Example 7 was followed except that the content of phthalocyanine pigment was changed to 2.5%. As a result, a particulate cyan toner having a good particle size distribution such that the volume-average particle diameter thereof is 5.1 μm, the ratio of 50%-volume particle diameter/50%-number particle diameter is 1.12 and the square root of the ratio of 84%-volume particle diameter/16%-volume particle diameter is 1.12 was obtained. The particulate cyan toner thus obtained also exhibited an average circularity of 0.990. The particle was then observed at a section thereof by TEM. As a result, the magenta pigment was found encapsulated and uniformly dispersed in the particle. To the particulate toner thus obtained were then added the same additives as used in Toner Preparation Example 1 to prepare a powder toner 8.

Toner Preparation Example 9

940 parts of the same polyester resin as used in Toner Preparation Example 7 and 60 parts of the same phthalocyanine pigment as used in Toner Preparation Example 7 were melt-kneaded, crushed, and then classified by means of a dry classifier to obtain an amorphous blue resin powder having a particle size distribution such that the volume-average particle diameter is 5.3 μm, the ratio of 50%-volume particle diameter/50%-number particle diameter is 1.34 and the square root of the ratio of 84%-volume particle diameter/16%-volume particle diameter is 1.32 and an average circularity of 0.943. To the blue resin powder were then externally added the same additives as used in Toner Preparation Example 1 to prepare a powder toner 9.

Examples 1, 2, 3 and 4

3 parts of each of powder toners 1, 2, 6 and 7 were mixed with 97 parts of an almost spherically particulate silicon resin-coated ferrite carrier having a volume-average particle diameter of 80 μm to prepare two-component developers 1, 2, 6 and 7, respectively.

Comparative Examples 1, 2, 3, 4, 5

3 parts of each of powder toners 3, 4, 5, 8 and 9 were mixed with 97 parts of an almost spherically particulate silicon resin-coated ferrite carrier having a volume-average particle diameter of 80 μm to prepare two-component developers 3, 4, 5, 8 and 9, respectively.

Test for Evaluating Developer

A commercially available copying machine (Ricoh Imagio MF-530) was loaded with the 9 kinds of developers prepared as mentioned above. Under these conditions, Test Chart No. 1 of The Society of Electrophotography of Japan was duplicated. The images thus obtained were then evaluated for quality. For the evaluation of resolution, the level of recognition of fine line pattern on the chart thus duplicated was judged. For the evaluation of tone reproduction, the level of recognition of tone reproduction pattern on the chart thus duplicated was judged. For the evaluation of fog, the non-printed area on the chart thus duplicated was visually judged. For the evaluation of image density, the solid area on the chart thus duplicated was measured by means of a Macbeth densitometer. Further, the amount of toner consumed when a 5% duty test pattern is duplicated by 1,000 sheets was measured. The results are set forth in Table 1 for black toner and in Table 2 for color toner.

All the examples of the present invention exhibit excellent image quality. These examples also show a drastically reduced consumed amount of toner. In Comparative Example 2, the particulate toners thus used exhibit a large volume-average particle diameter and hence are consumed in an increased amount. Comparative Examples 3 and 5 use non-spherically particulate toners obtained by pulverization process which are consumed in an increased amount, cause fog and provide a slightly lowered image density. Further, Comparative Examples 1 and 4 use toners which are consumed in a reduced amount but have a reduced colorant content and hence provide a lowered image density.

TABLE 1

| Example No. | Developer used | Consumed amount of toner (g) | Fog | Resolution | Tone reproduction | Image density |
|---|---|---|---|---|---|---|
| Example 1 | Developer 1 | 10.1 | None | + | + | 1.60 |
| Example 2 | Developer 2 | 8.5 | None | + | + | 1.45 |
| Comparative Example 1 | Developer 3 | 10.2 | None | + | + | 1.30 |
| Comparative Example 2 | Developer 4 | 19.8 | None | Standard | Standard | 1.56 |
| Comparative Example 3 | Developer 5 | 15.1 | Observed | 0 | 0 | 1.33 |

TABLE 2

| Example No. | Developer used | Consumed amount of toner (g) | Fog | Resolution | Tone reproduction | Image density |
|---|---|---|---|---|---|---|
| Example 3 | Developer 6 | 10.5 | None | + | + | 1.47 |
| Example 4 | Developer 7 | 11.7 | None | + | + | 1.50 |
| Comparative Example 4 | Developer 8 | 11.9 | None | + | + | 1.24 |
| Comparative Example 5 | Developer 9 | 16.3 | Observed | 0 | 0 | 1.33 |

Consumed amount of toner: amount (g) consumer per 1,000 sheets of printing paper
Resolution, tone reproduction: +: better than standard; 0: almost equal to standard
Standard: developer of Comparative Example 2

What is claimed is:

1. An electrostatic image developer comprising a spherically particulate black toner containing a binder resin and a colorant and a resin-coated carrier, characterized in that said spherically particulate toner has a volume-average particle diameter of from 1 to 6 $\mu$m, and an average circularity of not less than 0.97, said colorant is carbon black, the content of which is from 8 to 20% by weight based on the sum of the weight of said binder resin and said colorant and said carrier has a volume-average particle diameter of from 20 to 150 $\mu$m.

2. The electrostatic image developer according to claim 1, wherein said colorant is encapsulated in said binder resin.

3. The electrostatic image developer according to claim 1, wherein said spherically particulate toner has a particle size distribution such that the ratio of 50%-volume particle diameter/50%-number particle diameter is not more than 1.25 and the square root of the ratio of 84%-volume particle diameter/16%-volume particle diameter is not more than 1.25.

4. The electrostatic image developer according to claim 2, wherein said spherically particulate toner has a particle size distribution such that the ratio of 50%-volume particle diameter/50%-number particle diameter is not more than 1.25 and the square root of the ratio of 84%-volume particle diameter/16%-volume particle diameter is not more than 1.25.

5. The electrostatic image developer according to claim 1, wherein said binder resin for said spherically particulate black toner is a polyester resin.

6. The electrostatic image developer according to claim 3, wherein said binder resin for said spherically particulate black toner is a polyester resin.

7. The electrostatic image developer according to claim 1, wherein said spherically particulate toner is a negatively polar toner comprising a hydrophobic silica and a hydrophobic titanium oxide externally added thereto.

8. The electrostatic image developer according to claim 2, wherein said spherically particulate toner is a negatively polar toner comprising a hydrophobic silica and a hydrophobic titanium oxide externally added thereto.

9. The electrostatic image developer according to any one of claims 1, 3 or 5, wherein said spherically particulate black toner is a particulate toner obtained by a process which comprises mixing a mixture comprising a colorant and a water-insoluble binder resin as essential components and an aqueous medium, emulsifying the mixture to form spherical colored particles, and then withdrawing the said particles dispersed in the liquid medium in the form of dried powder.

10. The electrostatic image developer according to claims 1, 3 or 5, wherein said spherically particulate toner is a particulate toner obtained by a process which comprises mixing a mixture comprising a colorant a self-water-dispersible resin upon neutralization and an organic solvent as essential components and an aqueous medium in the presence of a neutralizing agent in an amount enough to make the resin to be self-water-dispersible, emulsifying the mixture to form spherical colored particles, and then withdrawing the said particles dispersed in the liquid medium in the form of dried powder.

11. The electrostatic image developer according to claim 1, wherein said spherically particulate is a particulate toner obtained by a process which comprises allowing a polymerizable monomer having a colorant dispersed therein to undergo polymerization in a liquid medium to form spherical colored particles, and then withdrawing the said particles dispersed in the liquid medium in the form of dried powder.

12. The electrostatic image developer according to claim 2, wherein said spherically particulate is a particulate toner obtained by a process which comprises allowing a polymerizable monomer having a colorant dispersed therein to undergo polymerization in a liquid medium to form spherical colored particles, and then withdrawing the said particles dispersed in the liquid medium in the form of dried powder.

13. An electrostatic image developer comprising a spherically particulate black toner containing a binder resin and a colorant and a resin-coated carrier, characterized in that said spherically particulate toner has a volume-average particle diameter of from 1 to 6 $\mu$m, and an average circularity of not less than 0.97, said colorant is carbon black, the content of which is from 9 to 15% by weight based on the sum of the weight of said binder resin and said colorant and said carrier has a volume-average particle diameter of from 20 to 150 $\mu$m.

14. The electrostatic image developer according to claim 13, wherein said colorant is encapsulated in said binder resin.

15. The electrostatic image developer according to claim 13, wherein said spherically particulate black toner has a particle size distribution such that the ratio of 50%-volume particle diameter/50%-number particle diameter is not more than 1.25 and the square root of the ratio of 84%-volume particle diameter/16%-volume particle diameter is not more than 1.25.

16. The electrostatic image developer according to claim 14, wherein said spherically particulate toner has a particle size distribution such that the ratio of 50%-volume particle diameter/50%-number particle diameter is not more than 1.25 and the square root of the ratio of 84%-volume particle diameter/16%-volume particle diameter is not more than 1.25.

17. The electrostatic image developer according to claim 13, wherein said binder resin for said spherically particulate black toner is a polyester resin.

18. The electrostatic image developer according to claim 15, wherein said binder resin for said spherically particulate black toner is a polyester resin.

19. The electrostatic image developer according to claim 13, wherein said spherically particulate toner is a negatively polar toner comprising a hydrophobic silica and a hydrophobic titanium oxide externally added thereto.

20. The electrostatic image developer according to claim 14, wherein said spherically particulate toner is a negatively polar toner comprising a hydrophobic silica and a hydrophobic titanium oxide externally added thereto.

21. The electrostatic image developer according to claim 13, wherein said spherically particulate toner is a particulate toner obtained by a process which comprises mixing a mixture comprising a colorant and a water-insoluble binder resin as essential components and an aqueous medium, emulsifying the mixture to form spherical colored particles, and then withdrawing the said particles dispersed in the liquid medium in the form of dried powder.

22. The electrostatic image developer according to claim 14, wherein said spherically particulate toner is a particulate toner obtained by a process which comprises mixing a mixture comprising a colorant and a water-insoluble binder resin as essential components and an aqueous medium, emulsifying the mixture to form spherical colored particles, and then withdrawing the said particles dispersed in the liquid medium in the form of dried powder.

23. The electrostatic image developer according to claim 13, wherein said spherically particulate is a particulate toner obtained by a process which comprises allowing a polymerizable monomer having a colorant dispersed therein to undergo polymerization in a liquid medium to form spherical colored particles, and then withdrawing the said particles dispersed in the liquid medium in the form of dried powder.

24. The electrostatic image developer according to claim 14, wherein said spherically particulate is a particulate toner obtained by a process which comprises allowing a polymerizable monomer having a colorant dispersed therein to undergo polymerization in a liquid medium to form spherical colored particles, and then withdrawing the said particles dispersed in the liquid medium in the form of dried powder.

25. The electrostatic image developer according to claim 1, wherein said resin-coated carrier is an almost spherically resin-coated carrier coated with a silicon resin.

26. The electrostatic image developer according to claim 13, wherein said resin-coated carrier is an almost spherically resin-coated carrier coated with a silicon resin.

27. The electrostatic image developer according to claim 2 or 6, wherein said resin-coated carrier is an almost spherically resin-coated carrier coated with a silicon resin and has a volume-average particle diameter of from 20 to 80 $\mu$m.

28. An electrostatic image developer comprising a spherically particulate color toner containing a binder resin and a colorant and a resin-coated carrier, characterized in that said spherically particulate color toner has a volume-average particle diameter of from 1 to 6 $\mu$m and an average circularity of not less than 0.97, said colorant is an organic pigment, the content of which is from 3 to 20% by weight based on the sum of the weight of said binder resin and said colorant and said carrier has a volume-average particle diameter of from 20 to 150 $\mu$m.

29. The electrostatic image developer according to claim 28, wherein said spherically particulate color toner has a particle size distribution such that the ratio of 50%-volume particle diameter/50%-number particle diameter is not more than 1.25 and the square root of the ratio of 84%-volume particle diameter/16%-volume particle diameter is not more than 1.25.

30. The electrostatic image developer according to claim 28, wherein said binder resin for said spherically particulate color toner is a polyester resin.

31. The electrostatic image developer according to claim 29, wherein said binder resin for said spherically particulate color toner is a polyester resin.

32. An electrostatic image developer comprising a spherically particulate color toner containing a binder resin and a colorant and a resin-coated carrier, characterized in that said spherically particulate color toner has a volume-average particle diameter of from 1 to 6 $\mu$m and an average circularity of not less than 0.97, said colorant is an organic pigment, the content of which is from 5 to 10% by weight based on the sum of the weight of said binder resin and said colorant and said carrier has a volume-average particle diameter of from 20 to 150 $\mu$m.

33. The electrostatic image developer according to claim 32, wherein said spherically particulate color toner has a particle size distribution such that the ratio of 50%-volume particle diameter/50%-number particle diameter is not more than 1.25 and the square root of the ratio of 84%-volume particle diameter/16%-volume particle diameter is not more than 1.25.

34. The electrostatic image developer according to claim 32, wherein said binder resin for said spherically particulate color toner is a polyester resin.

35. The electrostatic image developer according to claim 33, wherein said binder resin for said spherically particulate color toner is a polyester resin.

36. The electrostatic image developer according to claim 28, 29 or 30, wherein said spherically particulate color toner is a particulate toner obtained by a process which comprises mixing a mixture comprising a colorant and a water-insoluble binder resin as essential components and an aqueous medium, emulsifying the mixture to form spherical colored particles, and then withdrawing the said particles dispersed in the liquid medium in the form of dried powder.

37. The electrostatic image developer according to claim 28, 29 or 30, wherein said spherically particulate color toner is a particulate toner obtained by a process which comprises mixing a mixture comprising a colorant, a self-water-dispersible binder resin upon neutralization and an organic solvent as essential components and an aqueous medium in the presence of a neutralizing agent in an amount enough to make the resin to be self-water-dispersible, emulsifying the mixture to form spherical colored particles, and then withdrawing the said particles dispersed in the liquid medium in the form of dried powder.

38. The electrostatic image developer according to claim 29 or 33, wherein said resin-coated carrier is an almost spherically resin-coated carrier coated with a silicon resin and has a volume-average particle diameter of from 20 to 80 $\mu$m.

* * * * *